US005920741A

United States Patent [19]

Nishimoto

[11] Patent Number: 5,920,741

[45] Date of Patent: Jul. 6, 1999

[54] FILM GUIDE DEVICE FOR FILM ATTACHMENT

[75] Inventor: Yoji Nishimoto, Wakayama, Japan

[73] Assignee: Noritsu Koki Co., Ltd., Wakayama, Japan

[21] Appl. No.: 08/835,567

[22] Filed: Apr. 9, 1997

[30] Foreign Application Priority Data

Apr. 10, 1996 [JP] Japan ..... 8-088324

[51] Int. Cl.[6] ..... G03D 3/08

[52] U.S. Cl. ..... 396/612; 396/646

[58] Field of Search ..... 396/516, 440, 396/387, 612, 512, 646, 599, 600, 620, 441; 226/39; 352/184

[56] References Cited

U.S. PATENT DOCUMENTS

| | | | |
|---|---|---|---|
| 2,336,278 | 12/1943 | Mihalyi | 396/411 |
| 4,114,996 | 9/1978 | Shaw | 352/184 |
| 4,134,655 | 1/1979 | Friedman | 396/583 |
| 4,423,943 | 1/1984 | Gold | 396/512 |
| 4,956,658 | 9/1990 | Smart | 396/516 |
| 4,992,812 | 2/1991 | Smart | 396/440 |
| 5,721,610 | 2/1998 | Kiten et al. | 396/411 |

*Primary Examiner*—D. Rutledge
*Attorney, Agent, or Firm*—Wenderoth, Lind & Ponack, L.L.P.

[57] ABSTRACT

A film guide device for guiding a front end portion of a film to a position before a film cartridge so as to be positioned at a film attachment position includes a film bending portion for allowing the front end portion of the film to be positioned at the film attachment position in a state in which the front end portion is bent in a widthwise direction of the film. The front end portion of the film being bent or curved in a widthwise direction of the film enables it to be made stiff. As a result, the front end of the film can be precisely positioned at the film attachment position and thus failure of hooking a film with the attaching tool can be prevented.

9 Claims, 9 Drawing Sheets

FILM GUIDE DEVICE FOR FILM ATTACHMENT

BACKGROUND OF THE INVENTION

The present invention relates to a film guide device for guiding a film to a film attachment position when the film is rewound into a cartridge.

Recently, there has been proposed a cartridge C as shown in FIG. 9 which is so designed that a film F, after being drawn out from cartridge and then processed, can be returned to cartridge C. This type of cartridge C includes a film entrance C1 that can be opened and closed and a spool C2 having a hooking claw C3, as shown in FIG. 10. A front end of a developed film F can be hooked by the hooking claw C3 to be rewound into the cartridge C.

Attachment of the film F to the cartridge C is achieved in the following manner by using an attaching tool 100 and a guide device 101, as shown in FIG. 11.

The front end portion of the developed film F is guided to its film attachment position in front of the film entrance C1 of the cartridge C by the guide device 101. Then, the front end portion of the film F is hooked by the attaching tool 100 and is penetrated into the cartridge C from the film entrance C1. Then, attachment holes (not shown) at the front end portion of the film F are hooked by the hooking claw C3 of the spool C2, for achieving film attachment.

The terms of "attachment" and "film attachment" as employed herein mean that the front end portion of the film F is attached to the spool C2 of the cartridge C.

For film attachment to be successful, it is an essential precondition that the front end of the film F is precisely positioned at the film attachment position. However, the film F has low resistance to bending in a longitudinal direction thereof. Thus, when the front end portion of the film F positioned at the film attachment position is projected from the guide device 101 and released therefrom, as shown in FIG. 11, it becomes hard to stably maintain the front end of the film F in the correct position. This causes a problem that the film F is liable to not be hooked by the attaching tool 100.

SUMMARY OF THE INVENTION

The present invention has been made to avoid the above described problems. The object of the present invention is to provide a film guide device for film attachment which enables the front end of the film to be precisely positioned at its film attachment position with the film being rendered stiff by being bent, and also enables the structure to be simplified with the need for electrical components such as a solenoid being eliminated.

To achieve the object described above, a film guide device for film attachment, according to the invention, for guiding a front end portion of a film to a position before a film cartridge so as to be positioned at its film attachment position comprises a film bending portion for allowing the front end portion of the film to be positioned at the film attachment position in a state in which the front end portion is bent in a widthwise direction of the film.

It is preferable that the film bending portion comprises a film transport passage having a width smaller than a width of the film and a film guide passage for introducing the film into the film transport passage.

Further, it is desirable that the film guide device includes a roller contactable with a surface of the film to control the film to be bent in a specified direction.

BRIEF DESCRIPTION OF THE DRAWINGS

The invention will now be described with reference to the accompanying drawings wherein.

DETAILED DESCRIPTION OF THE PREFERRED EMBODIMENT

Referring now to the accompanying drawings, an example of the preferred embodiment of the film guide device of the invention is described below. It is to be understood, however, that the scope of the invention is by no means limited to the illustrated embodiment.

An automatic film processing apparatus of the invention is so designed that after an undeveloped film F1 is drawn out from a cartridge C and then is processed, the developed film F can be rewound in the cartridge C.

Figure 1:
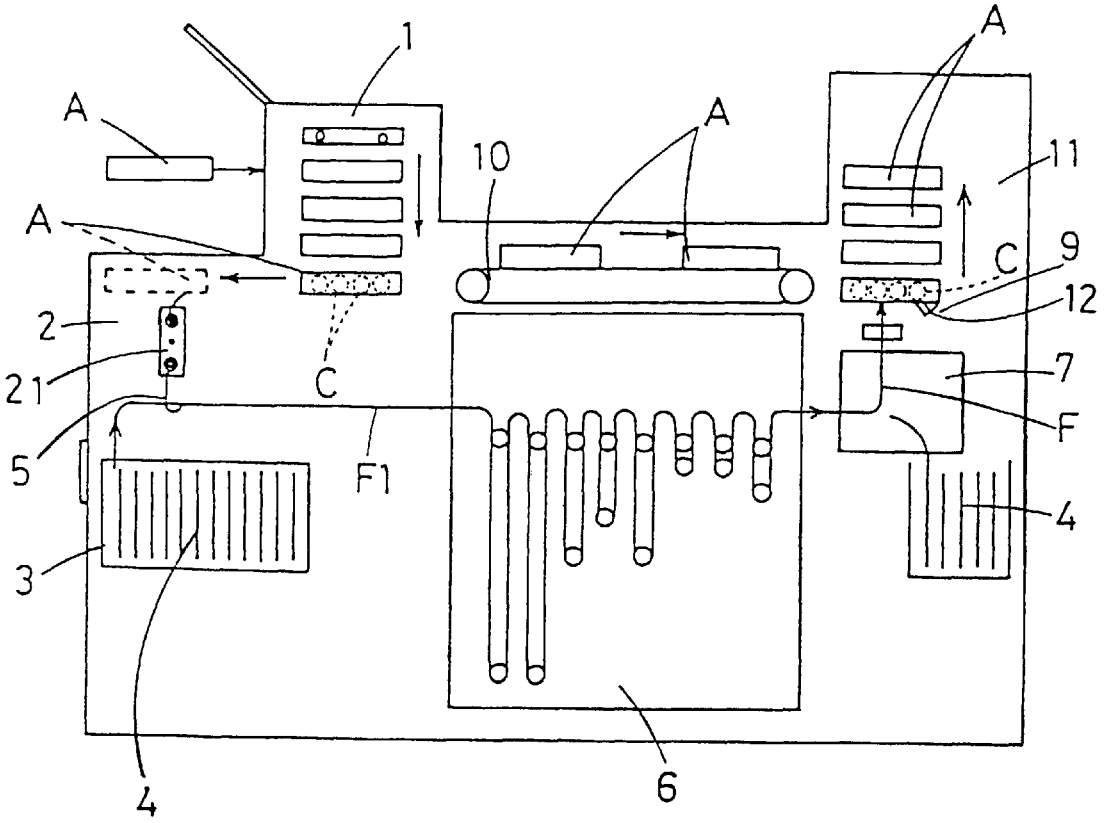
FIG. 1 is an schematic illustration of a film processing apparatus.

As shown in FIG. 1, the automatic film processing apparatus comprises a case supply portion 1 for supplying storage cases A one by one, each case storing the cartridges C containing undeveloped films F1; a film transferring portion 2 for drawing out the undeveloped film F1 from each cartridge C in each storage case A supplied from the case supply portion 1 and winding the thus drawn out undeveloped film onto a winding cartridge 21; a splicing portion 5 for splicing the undeveloped film F1 wound on the winding cartridge 21 to a film leader 4 supplied from a film leader supplying portion 3; a film processing portion 6 for processing the undeveloped film F1 spliced to the film leader 4; a separating unit 7 for separating the developed film F from the film leader 4; a transporting belt 10 for transporting each of the storage cases A, which stores the cartridges from which the undeveloped films F1 were emptied, from the film transferring portion 2 to a film rewinding portion 9; a first pair of transporting rollers R (FIG. 2) for transporting the developed film F separated from the film leader 4 to the film rewinding portion 9; and a case stock portion 11 for stocking the storage cases A storing the cartridges C containing the as-rewound, developed films F.

At the film entrance C1 of the cartridge C, a shutter (not shown) is supported via a shaft as to be freely opened and closed. Also, spool C2 is housed in the cartridge C, and hooking claws C3 are formed on the spool C2 (FIG. 2).

Figure 2:
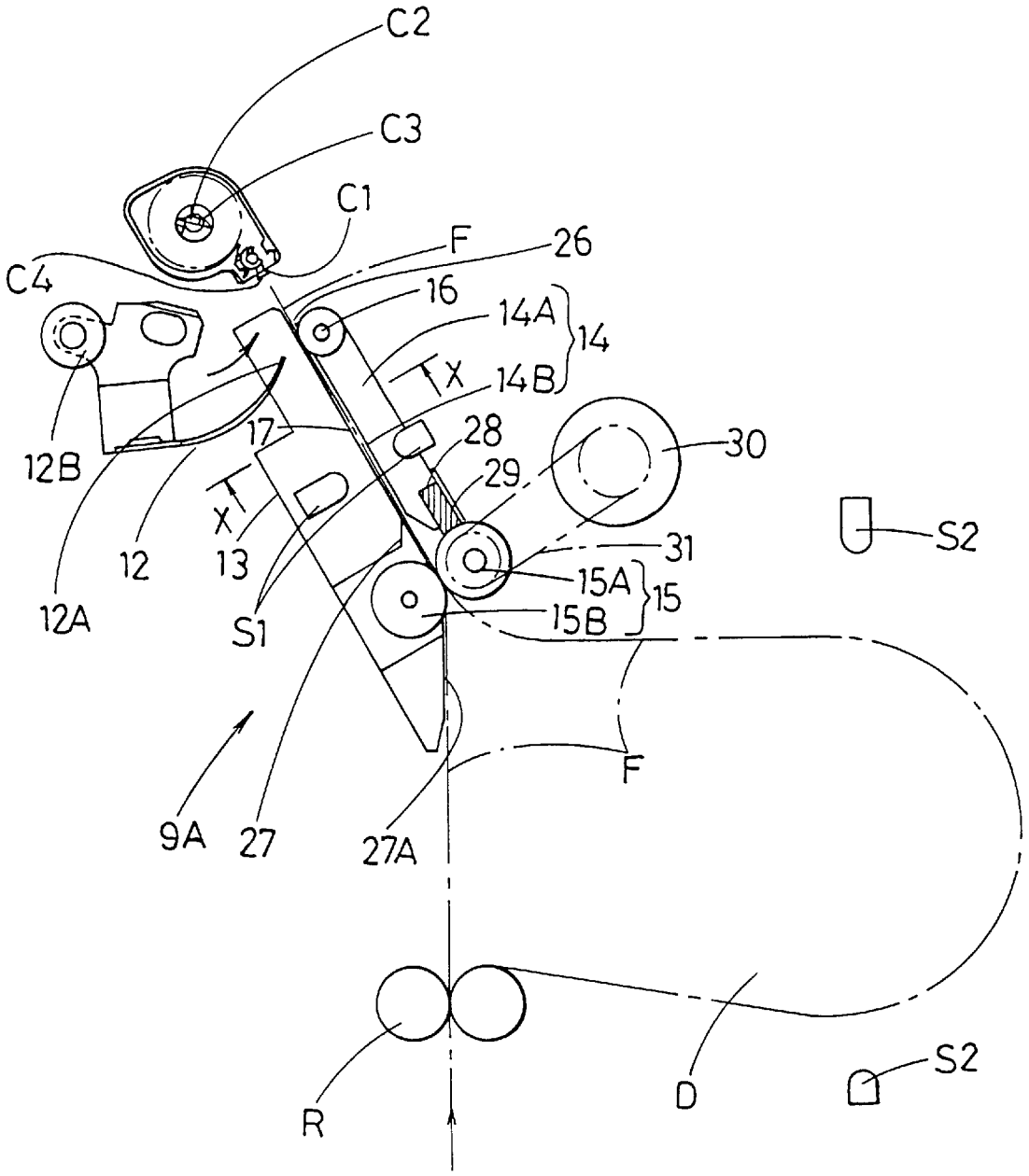
FIG. 2 is a side view of a film guide device of a preferred embodiment of the invention.

The film rewinding portion 9 is provided, as shown in FIG. 2, with a rewinding device 9A for rewinding the developed film F, separated from the film leader 4, into the related cartridge C in the storage case A positioned at the film rewinding portion 9. The rewinding device 9A comprises an attaching tool 12; a film guide device 13; a cartridge shutter open and close device (not shown); and a spool shaft rotation means (not shown) for the cartridge.

Figure 3:
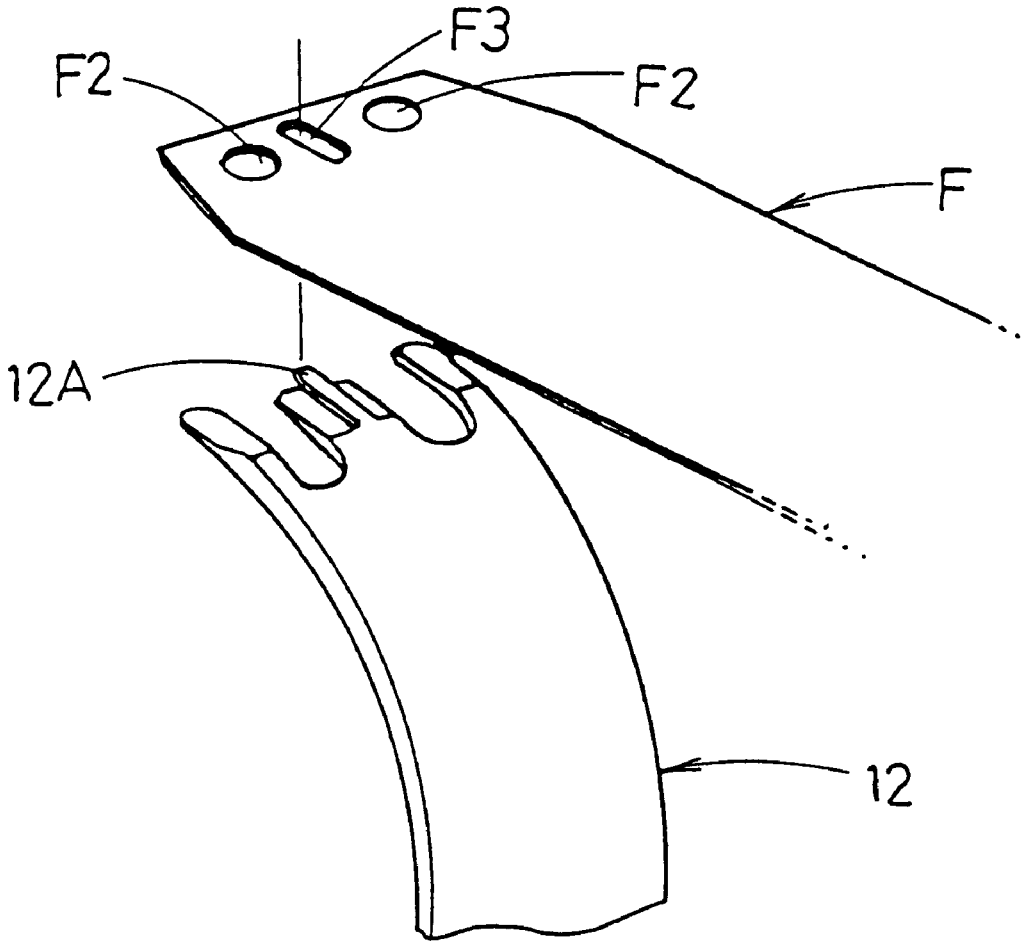
FIG. 3 is a perspective view illustrating the operation of a film being hooked by an attaching tool.

As shown in FIG. 2, the attaching tool 12 is mounted on a rotation means 12B so that it can penetrate into the cartridge C at a specified angle (as indicated by an arrow in FIG. 2). Also, as shown in FIG. 3, the attaching tool 12 is provided at its front end with a hooking claw 12A which is engageable in a center attachment hole F3 formed on the front end portion of the developed film F. After the film F is hooked at the center attachment hole F3 by the hooking claw 12A with the attaching tool 12 rotated, the attaching tool 12 is rotated further to drive the front end portion of the attaching tool 12 to penetrate into the cartridge C from the film entrance C1 of the cartridge C. Then, the hooking claws C3 of the spool C2 hooks side attachment holes F2 formed on the front end of the developed film F and thereby the film attachment is effected.

The film guide device 13 operates to guide the front end of the developed film F to a position before the cartridge C so as to be positioned at the film attachment position at which the developed film F can be hooked at its center attachment hole F3 by the hooking claw 12A of the attaching tool 12.

Figure 4:
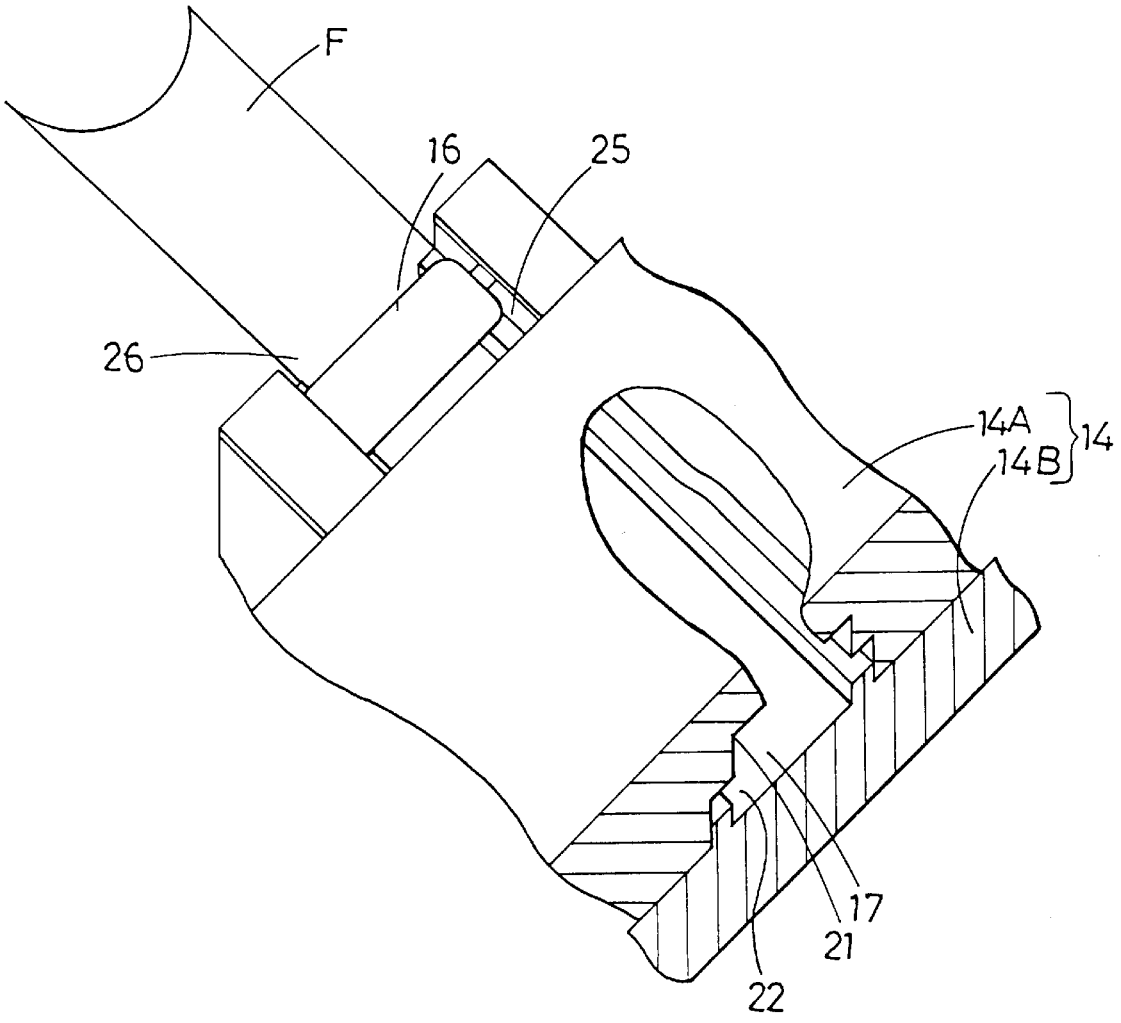
FIG. 4 is a partially broken perspective view of the film guide device of the preferred embodiment of the invention.
Figure 5:
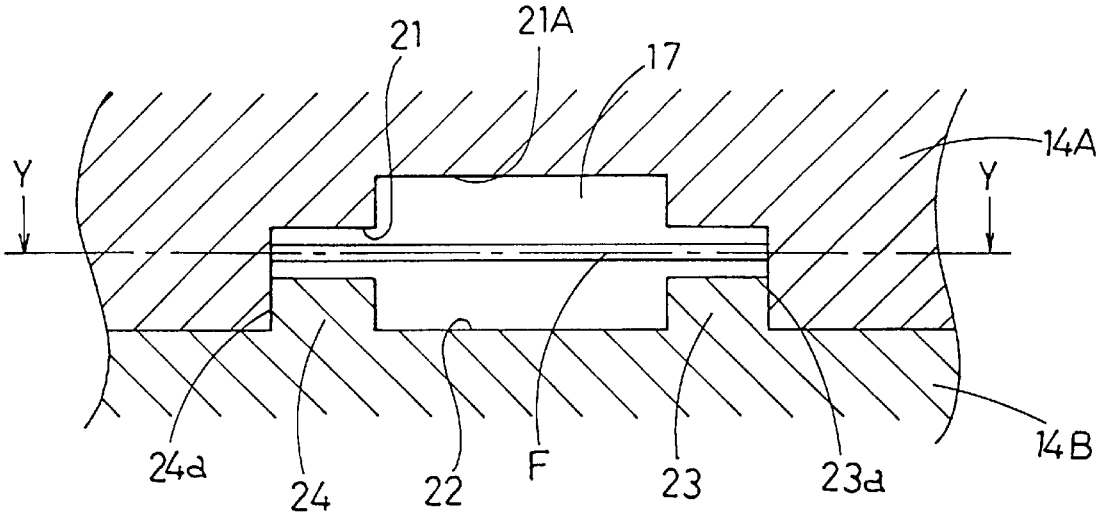
FIG. 5 is a sectional view taken on line X—X of FIG. 2.

As shown in FIGS. 2 and 4, the film guide device 13 comprises a guide element 14; first and second film sensors S1, S2; a second pair of transporting rollers 15; and a roller 16 for limiting the direction in which the developed film F is curved in a film guide passage 17 forming a film bending portion, to a specified direction, as described later.

The guide element 14 comprises a pair of mutually bonded, guiding members 14A, 14B, between which the film guide passage 17 forming the film bending portion is defined.

Figure 6:
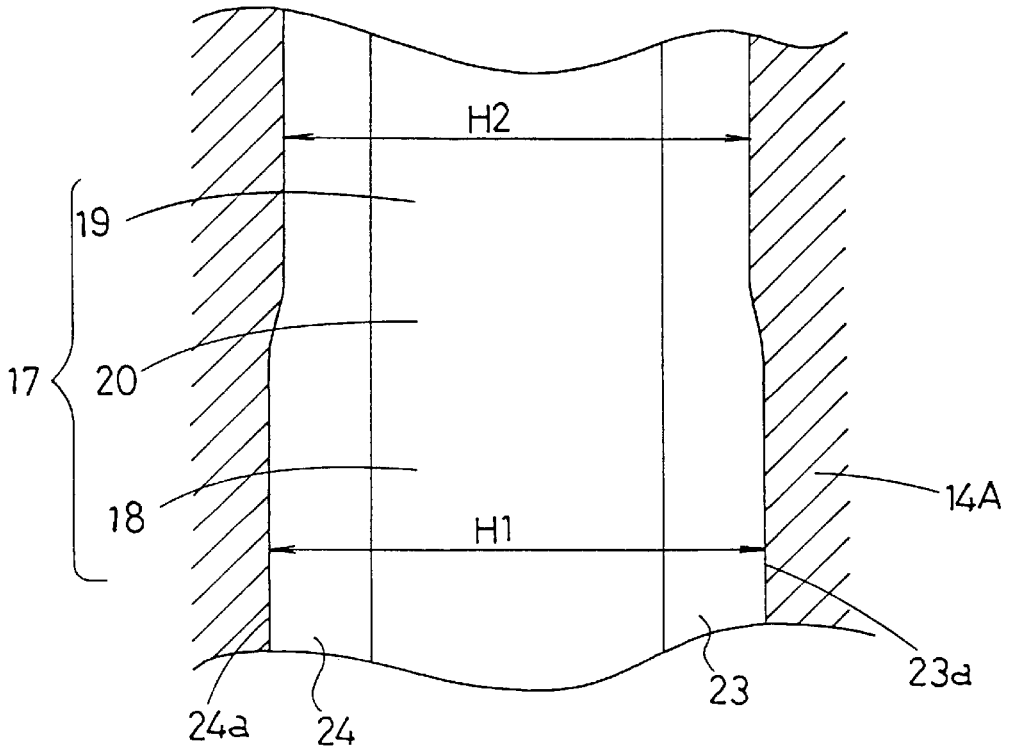
FIG. 6 is a sectional view taken on line Y—Y of FIG. 5.

As shown in FIG. 6, the film guide passage 17 includes a film inflow passage 18; a film transport passage 19; and a film guide passage 20 for forcing the film to be bent or curved while being fed from the film inflow passage 18 to the film transport passage 19.

The film inflow passage 18 of the film guide passage 17 is so formed as to have the same width H1 as the film, whereas the film transport passage 19 is so formed as to have a width H2 smaller than the film (e.g. the width H2 of the film transport passage 19 is set at 23.8 mm, with respect to a width of the film of 24 mm).

The film guide passage 20 is arranged between the film inflow passage 18 and the film transport passage 19 so that the film can be gently shifted from the width H1 of the film inflow passage 18 to the width H2 of the film transport passage 19. In detail, the film guide passage 20 is so arranged that its width increasingly narrows as the film goes farther in the outflow direction of the film. One end portion of the film guide passage 20 on the film outflow side has a width equal to the width H2 of the film transport passage 19 and the other end portion of the film guide passage 20 on the film inflow side has a width equal to the width H1 of the film inflow passage 18.

Further, the guide element 14 has a film inlet 27 at the end of the film inflow passage 18 on the film inflow side and a film outlet 26 at the end of the film transport passage 19 on the film outflow side.

The film guide passage 17 is formed by film-guide-passage forming grooves 21, 22 of the guiding members 14A, 14B being aligned with each other. The film-guide-passage forming grooves 21, 22 are formed on the bonding surfaces of the guiding members 14A, 14B, respectively.

The film-guide-passage forming groove 21 is provided at its widthwise center portion with a center groove 21A. On the bonding surface of the guiding member 14B are formed two guide projections 23, 24, between which the film-guide-passage forming groove 22 is defined. The outside surfaces 23*a*, 24*a* of the two guide projections 23, 24 located on the film outflow side are shaped corresponding to the widthwise dimensions of the film-guide-passage forming grooves 21, 22.

Figure 7:
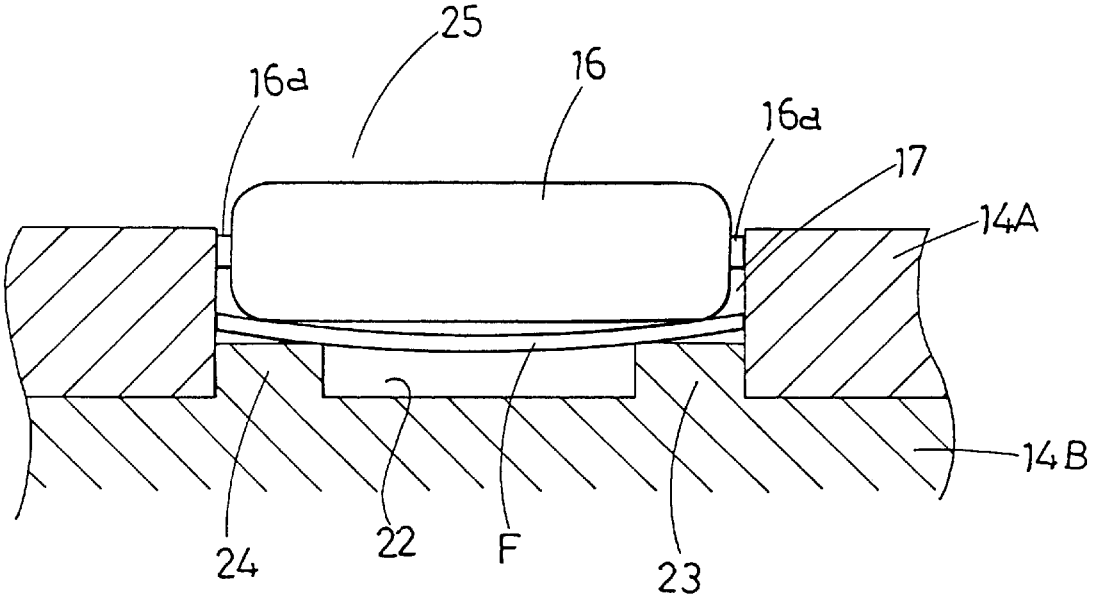
FIG. 7 is an enlarged sectional view illustrating a main part of the film guide device of the invention.

The film guide passage 17 located on the film outflow side is, as shown in FIGS. 4 and 7, in the form of an open conduit 25 opening to the guiding member 14A side, and the roller 16 mentioned above is freely rotatably housed in the open conduit 25. A roller shaft 16*a* of the roller 16 is mounted on the inside walls of the open conduit 25, and the roller 16 is disposed in the vicinity of the guide projections 23, 24 of the guiding member 14B.

The film outlet 26 of the guide element 14 confronts the film entrance C1 of the cartridge C at a cartridge setting portion, and the guiding member 14B on the film inflow side of the guide element 14 has a film guide surface 27A extending continuously to a marginal portion of the film inlet 27.

The second pair of transporting rollers 15 located at the end portion of the guide element 14 on the film inflow side comprises a cleaning roller 15A to dust the film and a pressure roller 15B. 28 denotes a roller cleaner and 29 designates a cleaner support.

Shown by 30 is a roller driving motor, and a rotational driving force from the motor 30 is transmitted to the cleaning roller 15A through a transmission belt 31.

At the film guide passage 17 of the guide element 14 are disposed, the first film sensors S1 of the transmission type (projector and receptor in pairs). The first film sensors S1 operate to detect the front end of the developed film F located in the film inflow passage 18 upstream from the narrowed film transport passage 19, to transmit stop signals to a drive circuit of the motor 30, so as to stop the motor 30.

Between the guide element 14 and the first pair of transporting rollers R to transport the developed film F to the film rewinding portion 9 is provided, a film looping portion D are disposed. In the film looping portion D, the second film sensors S2 of the transmission type (projector and receptor in pairs).

The film F processed in the film processing portion 6 is transported to the film rewinding portion 9 to be rewound in the related cartridge C in the storage case A located at the film rewinding portion 9. The rewinding operation of the developed film F is described below.

First, the developed film F processed in the film processing portion 6 is transported to the first pair of transporting rollers R and in turn to the film guide passage 17 in the guide element 14 of the film guide device 13.

Then, when the front end of the developed film F passing along the film guide passage 17 in the guide element 14 is detected by the first film sensors S1, a signal from sensors S1 stop the drive circuit of the motor 30, to stop the film transported by the second pair of rollers 15.

After that, the developed film F is looped in the film looping portion D under the transporting operation of the first pair of transporting rollers R.

Then, when the film has been looped to a certain extent, such condition is detected by the second film sensors S2, and signals from sensors S2 operate the drive circuit of the motor 30 to rotate the motor 30 backwardly, whereby the developed film F is retracted from the position detected by the first film sensors S1 and the detection thereby is rendered OFF. Thereafter, the motor 30 is rotated forwardly again, so that the front end of the developed film F is detected by the first film sensors S1.

Then, the developed film F is transported by a specified length toward the film attachment position and is bent or curved while passing along the film guide passage 20 in the guide element 14. The curvature of the developed film F increases as it travels farther to the film outflow side.

The curvature given at the terminal end portion of the film guide passage 20 is maintained while the developed film F travels along the film transport passage 19. Further, the state of the developed film F being curved toward the guiding member 14B of the guide element 14 is maintained by the roller 16 while the developed film passes out of the film outlet 26 of the guide element 14. Thus, the curved front end of the developed film F is transported to the film attachment position.

As a result, the front end of the developed film F is located at the film attachment position and is curved toward the guiding member 14B.

It is noted that when the front end of the developed film F is positioned at the film attachment position, a base end portion of the front end portion of the film F is in the narrowed film transport passage 19 of the film guide passage 17, such that the curvature of the front end of the developed film F is maintained at the film attachment position.

Thereafter, the front end of the developed film F is hooked by the attaching tool 12 upon rotation thereof and is penetrated into the cartridge C to be hooked by the spool C2 of the cartridge C. After being hooked by the spool C2, the developed film F is rewound in the cartridge C by rotating the spool C2 by the spool shaft rotation means.

Figure 8:
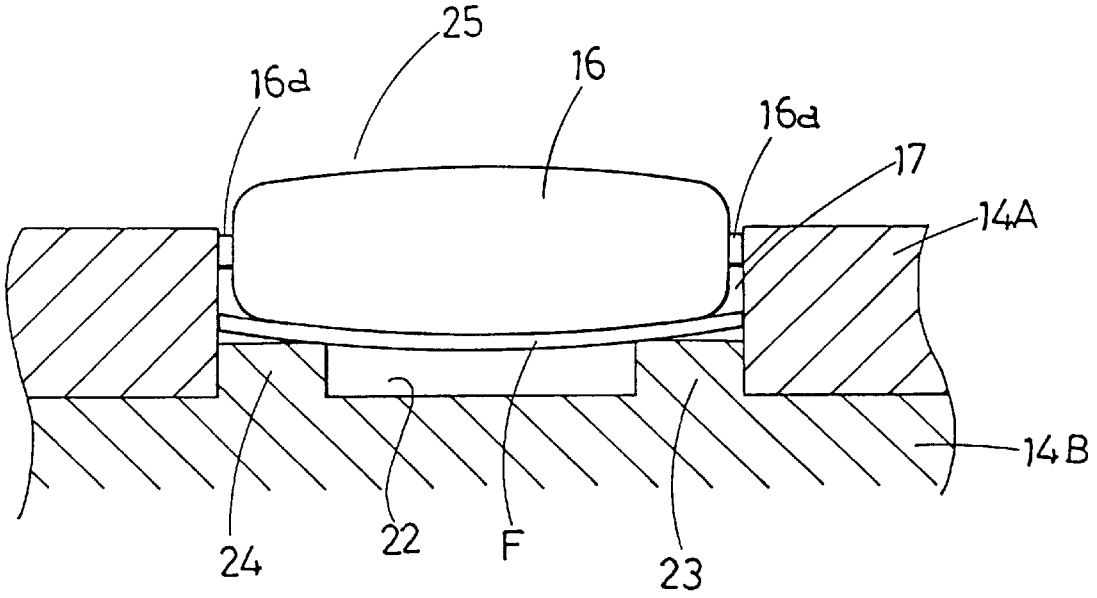
FIG. 8 is an enlarged sectional view illustrating a main part of a film guide device of another embodiment of the invention.
Figure 9:
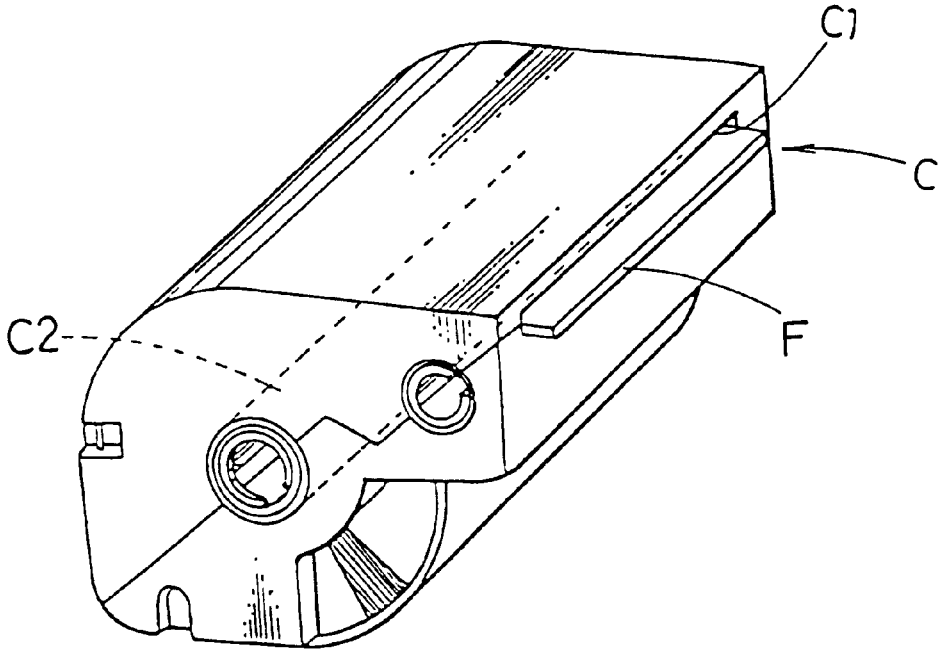
FIG. 9 is a perspective view illustrating a cartridge.
Figure 10:
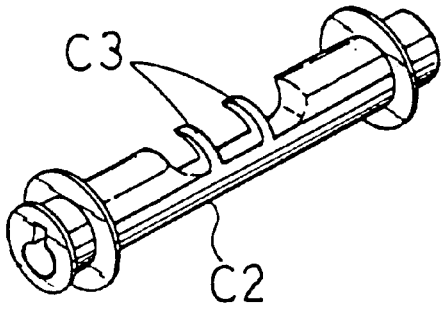
FIG. 10 is a perspective view of a spool shaft of the same cartridge.
Figure 11:
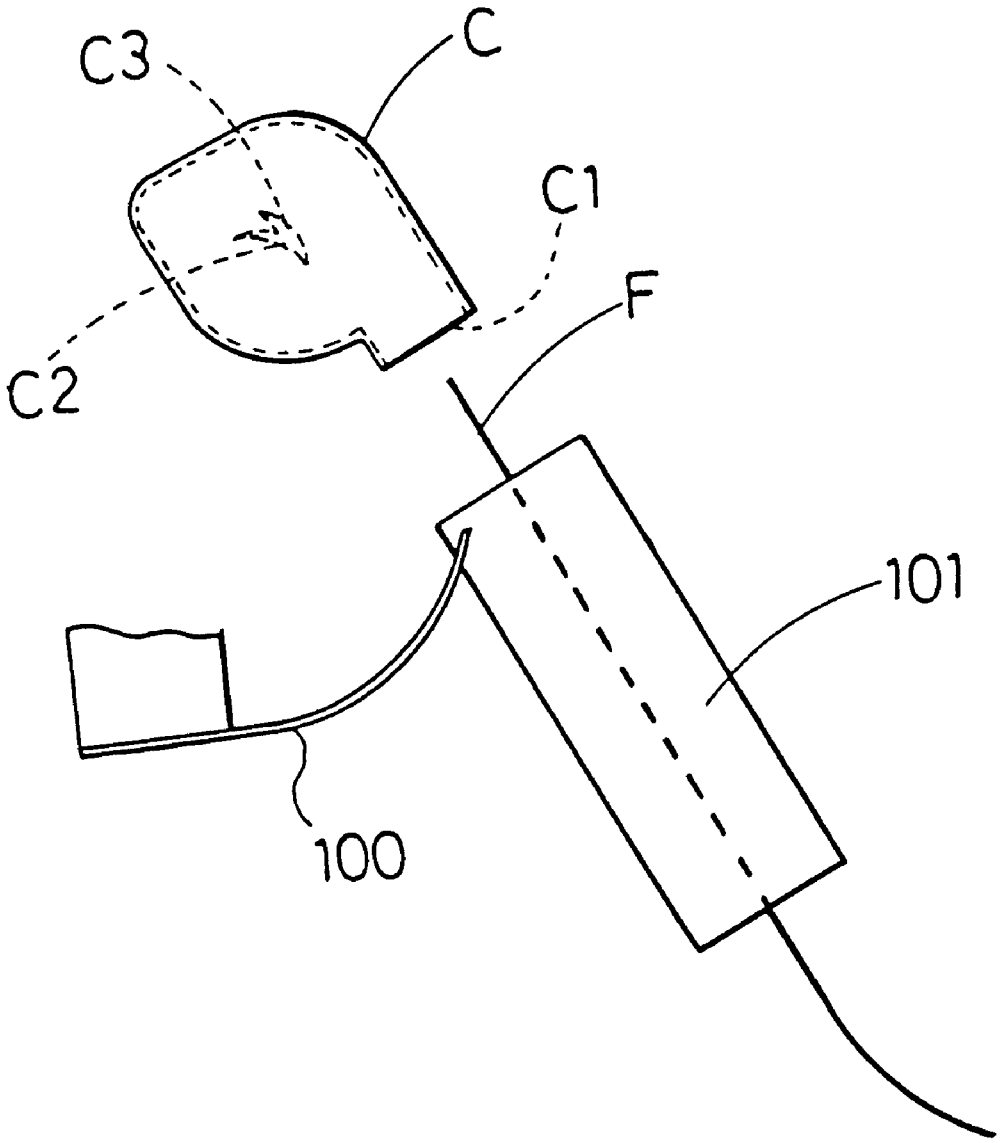
PRIOR ART Fig. 11
FIG. 11 is a side view of the film guide device of the prior art.

It is to be noted that the roller 16 may have a curved body as illustrated in FIG. 8, instead of a circular cylindrical body in the above illustrated embodiment.

What is claimed is:

1. A film guide device for guiding a front end portion of a film to a film attachment position at which the film is to be attached to a film cartridge to enable the film to be rewound in the cartridge, said device comprising:

a film bending portion for bending the front end of the film widthwise thereof, said film bending portion comprising a guide element having therein a groove forming a passage through said guide element; and a member contactable with a surface of the film to control the direction of bending thereof to be in a specified direction, said member being positioned to confront said groove and to cause the film to be bent toward said groove.

2. A device as claimed in claim 1, wherein said member comprises a roller.

3. A device as claimed in claim 2, wherein said roller has a circular cylindrical surface.

4. A device as claimed in claim 2, wherein said roller comprises a longitudinally curved body.

5. A film guide device for guiding a front end portion of a film to a film attachment position at which the film is to be attached to a film cartridge to enable the film to be rewound in the cartridge, said device comprising:

a film bending portion for bending the front end of the film widthwise thereof, a said film bending portion comprising a guide element having therethrough a film transport passage having a width to be smaller than a width of the film, and a film guide passage to introduce the film into said film transport passage; and a member contactable with a surface of the film to control the direction of bending thereof to be in a specified direction.

6. A device as claimed in claim 1, wherein said member comprises a roller.

7. A device as claimed in claim 6, wherein said roller has a circular cylindrical surface.

8. A device as claimed in claim 6, wherein said roller comprises a longitudinally curved body.

9. A device as claimed in claim 5, wherein said guide element has therein a groove forming film transport passage, and said member is positioned to confront said groove and to cause the film to be bend toward said groove.

* * * * *